United States Patent [19]

Toratani et al.

[11] Patent Number: 4,999,901

[45] Date of Patent: Mar. 19, 1991

[54] METHOD OF PRODUCING A NOZZLE MEMBER FOR SUCKING OR TRANSPORTING A STRING OF YARN

[75] Inventors: Hidenobu Toratani, Nanatsuka; Tamio Moribe, Kanazawa; Ryuuichi Takenaka, Takamatsu; Tooru Nakagawa, Komatsu, all of Japan

[73] Assignee: Tsudakoma Kogyo Kabushiki Kaisha, Kanazawa, Japan

[21] Appl. No.: 535,294

[22] Filed: Jun. 8, 1990

Related U.S. Application Data

[63] Continuation of Ser. No. 300,924, Jan. 24, 1989, abandoned.

[30] Foreign Application Priority Data

Jan. 25, 1988 [JP] Japan ..... 63-15432

[51] Int. Cl.[5] ..... B21C 1/16

[52] U.S. Cl. ..... 29/415; 29/890.142; 29/DIG. 11; 72/275

[58] Field of Search ..... 29/412, 414, 415, 890.142, 29/DIG. 11, DIG. 26, 890.128; 72/283, 367, 370, 275, 276; 139/450; 166/123

[56] References Cited

U.S. PATENT DOCUMENTS

| | | | |
|---|---|---|---|
| 616,357 | 12/1898 | Reynolds et al. | 72/283 X |
| 2,228,301 | 1/1941 | Ditzel et al. | 72/283 X |
| 2,408,325 | 9/1946 | Luce et al. | 72/283 X |
| 3,783,663 | 1/1974 | Prajsnar et al. | 72/283 X |
| 4,125,924 | 11/1978 | Goetze et al. | 29/412 X |
| 4,127,168 | 11/1978 | Hanson et al. | 166/123 |
| 4,312,210 | 1/1982 | Nishizawa et al. | 72/267 |
| 4,550,752 | 11/1985 | Manders | 139/435 |
| 4,606,212 | 8/1986 | Sunaga et al. | 72/283 |
| 4,658,866 | 4/1987 | Takegawa | 139/450 |
| 4,873,752 | 10/1989 | Suck | 29/890.128 |

FOREIGN PATENT DOCUMENTS

| | | | |
|---|---|---|---|
| 56-68137 | 6/1981 | Japan . | |
| 595781 | 12/1947 | United Kingdom | 72/283 |

*Primary Examiner*—Mark Rosenbaum
*Assistant Examiner*—Peter Dungba Vo
*Attorney, Agent, or Firm*—Oblon, Spivak, McClelland, Maier & Neustadt

[57] ABSTRACT

The invention provides a process of producing a nozzle member for sucking and transporting a string of yarn having an inner diameter which varies along an axial direction of the nozzle member. The process comprises the step of drawing a pipe stock having a predetermined outside profile so as to transfer the outside profile in an axial symmetrical relationship to an inside profile of the pipe stock. By the process, a nozzle member can be produced readily with a high degree of accuracy.

7 Claims, 2 Drawing Sheets

METHOD OF PRODUCING A NOZZLE MEMBER FOR SUCKING OR TRANSPORTING A STRING OF YARN

This application is a continuation of application Ser. No. 07/300,925, filed on Jan. 24, 1989, now abandoned.

BACKGROUND OF THE INVENTION

1. Field of the Invention

This invention relates to a process of production of a nozzle member of a small diameter having a inside tapered or stepped dispersing portion which is difficult to work.

2. Description of the Prior Art

In the field of textile machines, a technique for sucking or transporting a string of yarn by means of an air flow is used universally, and various types of nozzle members are used for the technique.

Various proposals have been made to such nozzle members in order to increase the speed of movement of a yarn string to be handled and minimize air consumption required for it. Typically, a dispersing portion of a nozzle member from a throat portion to an air exit is formed such that the diameter thereof is increased in a gentle linear taper or in several steps or else has an expanded portion formed intermediately thereof. Employment of any of such structures as described just above can prevent appearance of unnecessary impulse waves in an air flow within the nozzle and maintain an accelerating action of the air flow. Such a structure is disclosed, for example, in U.S. Pat. No. 4,550,752 and Japanese Patent Laid-Open No. 56-68137.

Generally, long-size pipe stocks which have a uniform inner diameter and are high in accuracy in dimension can be conventionally obtained readily as drawn stocks or extruded materials. However, generally it is very difficult to produce a nozzle member having such a special inside profile as a single part because of the facts that the axial length thereof is extremely great while the inner diameter is small and so on. Therefore, conventional processes of producing such a nozzle member commonly include steps of working a plurality of divided parts of a suitable length unit for the nozzle member by a means suitable for working for a small diameter such as, for example, wire cutting electric discharge machining and then assembling the divided parts into a unitary member.

With such a conventional technique as described above, however, a nozzle member cannot be produced as a single part. Accordingly, there are problems that the production cost is very high and that it is difficult to realize a predetermined degree of accuracy of products. Further, wire cutting electric discharge machining has another problem in that, since a wire is curved like a catenary as the working length is increased, it is difficult to attain a worked face of an accurate linear taper.

SUMMARY OF THE INVENTION

It is an object of the present invention to provide a process of producing a nozzle member by which a nozzle member having an arbitrary inside profile can be readily produced as a single part with a high degree of accuracy.

The above and other objects, features and advantages of the present invention will become apparent from the following description and the appended claims, taken in conjunction with the accompanying drawings.

DESCRIPTION OF THE PREFERRED EMBODIMENTS

As a material for a pipe stock from which a nozzle member is to be formed, a metal material is used which has a ductility that satisfies an area decreasing rate required in drawing but does not yield a crack or the like.

It is to be noted that the area decreasing rate R is defined by $$R=(D_0^2-D_1^2)/D_0^2$$

where $D_0$ is an outer diameter of a pipe stock before drawing and $D_1$ is an outer diameter of the pipe stock after drawing.

An exemplary one of such materials is an austenitic stainless steel such as SUS304L.

Figure 1A:
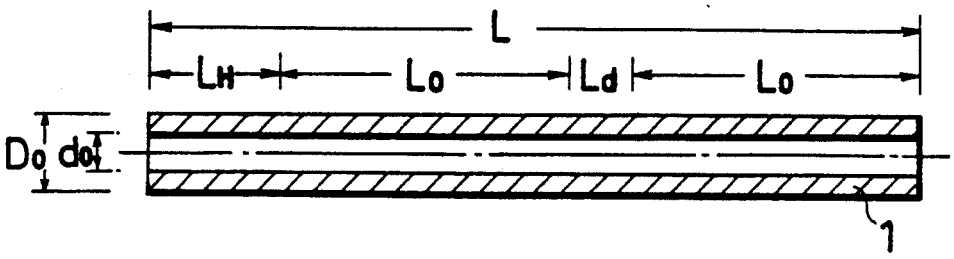
FIGS. 1(A) to 1(E) illustrate different steps of a process of producing a nozzle member according to the present invention, FIG. 1(A) being a hollow sectional view of a pipe stock to be worked, FIG. 1(B) being a side elevational view, partly in section, of the pipe stock after an outer periphery thereof is machined, FIG. 1(C) being a side elevational view, partly in section, of the pipe stock before drawing, FIG. 1(D) a sectional view of the pipe stock after drawing, and FIG. 1(E) being a sectional view of the nozzle member after the process is completed.
Figure 1B:
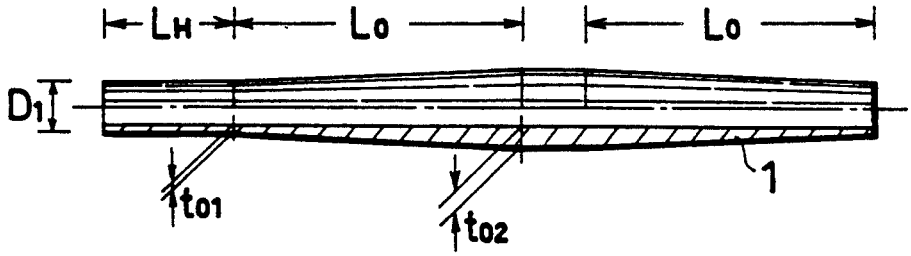
Figure 1C:
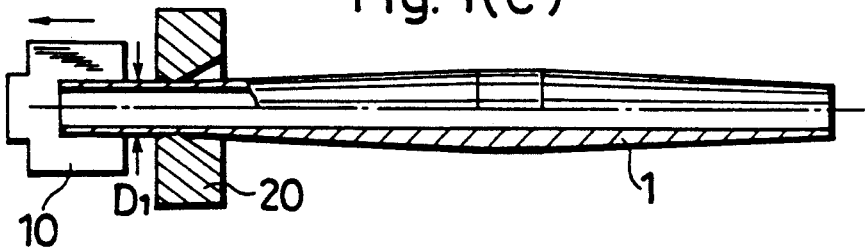
Figure 1D:
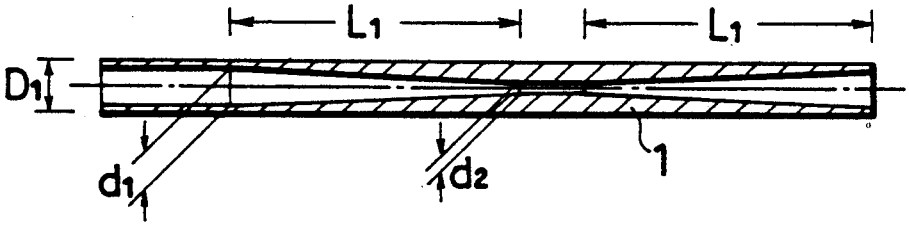
Figure 1E:
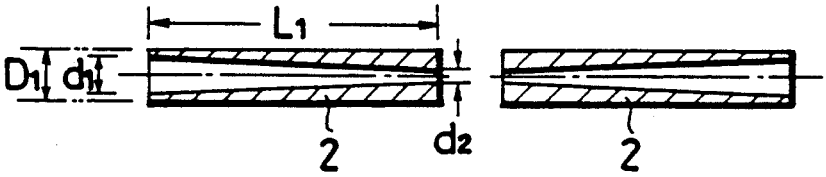

In the following, shaping of such a nozzle member 2 which has an outer diameter $D_1$ and a length $L_1$ and has an inside profile of a linear taper the inner diameter of which is $d_1$ at the greater diameter side and $d_2$ at the smaller diameter side as shown in FIG. 1(E) will be described in detail.

At first, such a hollow pipe stock 1 which has an outer diameter $D_0$, an inner diameter $d_0$ and a length $L=2L_0+L_H+L_d$ as shown in FIG. 1(A) is prepared as a stock. Here, $L_H$ is a grip length of a portion of the pipe stock 1 which is to be gripped by a holding tool 10, $L_d$ is a suitable cutting margin, and $L_0$ (represented by $L_0=L_1/\alpha$, where $\alpha$ is an elongation percentage in drawing and $\alpha>1$) is a length of a stock to make a nozzle member, and it is assumed that $d_0=d_1$ and $D_0 \geqq d_0+(D_1-d_2)$ are established. Here, however, it is assumed that two nozzle members of the same configuration are produced from a single stock.

Such a pipe stock 1 as described above is machined at an outside thereof into such a profile as shown in FIG. 1(B) by mechanical machining. In this instance, the portion of the pipe stock 1 within the grip length $L_H$ is finished into an outer diameter $D_1$ while other portions within the ranges of the length $L_0$ are finished into a linear taper profile such that they may have a thickness of material corresponding to the inside configuration of a nozzle member to be produced. In particular, each of the portions within the ranges of the length $L_0$ is finished such that the thicknesses of material $t_{01}$ and $t_{02}$ at the opposite ends thereof may be $t_{01}=(D_1-d_1)/2$ and $t_{02}=(D_1-d_2)/2$.

Then, the portion of the pipe stock 1 within the grip length $L_H$ is gripped by the holding tool 10 as shown in FIG. 1(C), and the pipe stock 1 is drawn in the direction indicated by an arrow mark by means of a die 20 which has an inner diameter equal to $D_1$. The die 20 used here may be of any known type such as a sintered alloy die. Meanwhile, the lubricant for drawing may be a dry type lubricant or a wet type lubricant.

Figure 2:
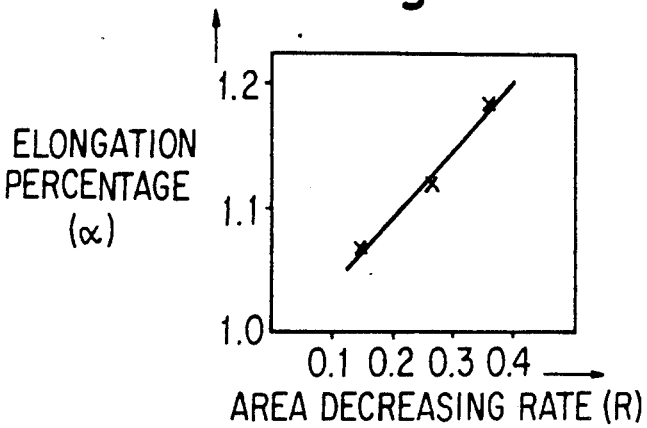
FIG. 2 is a graph illustrating a relationship between an area decreasing rate and an elongation percentage of a pipe stock in a drawing step.

During drawing, the pipe stock 1 is formed to have an outer diameter equal to $D_1$ over the overall length thereof while an outwardly projected portion of the pipe stock 1 is expanded inwardly so that the inner bore of the pipe stock 1 after completion of drawing is contracted substantially in an axial symmetrical relationship to the outer profile of the linear taper of the pipe stock 1 before drawing. Strictly speaking, the length of each of the drawn portions of the pipe stock 1 which have been formed into the inside linear tapers is equal to the length $L_1$ which coincides with the preset length of a nozzle member 2 to be produced while the inner diameters of the opposite end portions of each of the drawn portions of the pipe stock 1 which have the length $L_1$ present the maximum inner diameter $d_1$ and the minimum diameter $d_2$ of a nozzle member to be produced because the thicknesses of material $t_{01}$ and $t_{02}$ at the opposite end portions are maintained invariably. Then, if the pipe stock 1 is cut at opposite ends of the portions thereof having the length $L_1$, a pair of nozzle members 2 having a predetermined configuration are obtained as shown in FIG. 1(E). As shown in FIG. 2, the elongation percentage $\alpha$ upon drawing generally increases in a proportional relationship to the area decreasing rate R. Thus, in working of a pipe stock for an outside profile, an elongation percentage $\alpha$ is estimated in advance or found out in advance through an experiment, and the length $L_0$ of the stock is reduced by an extent corresponding to the elongation percentage $\alpha$. In other words, the length $L_0$ is set to $L_0=L_1/\alpha$. This will assure formation of a taper of an inside profile of a nozzle member with a higher degree of accuracy.

Where the area decreasing rate R has a high value, circumferential drawing wrinkles sometimes appear on an inner face of a pipe stock after drawing. Such drawing wrinkles can be removed by abrasive grain fluid polishing of the inside of a pipe stock after drawing or the inside of a nozzle member after cutting of the pipe stock in a suitable condition.

Figure 3A:
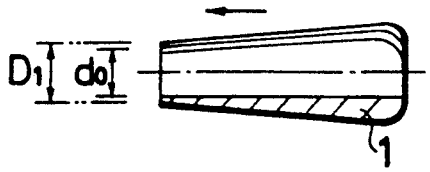
FIGS. 3(A) and 3(B), FIGS. 4(A) and 4(B) and FIGS. 5(A) and 5(B) illustrate different embodiments of the present invention, FIGS. 3(A), 4(A) and 5(A) being side elevational views, partly in section, of pipe stocks before drawing, and FIGS. 3(B), 4(B) and 5(B) being sectional views of nozzle members after drawing.
Figure 3B:
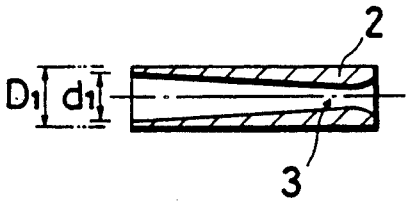
Figure 4A:
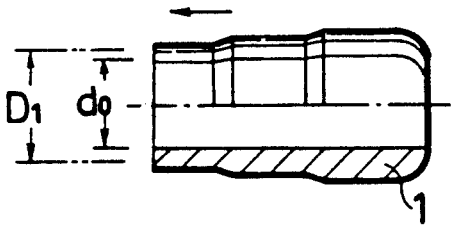
Figure 4B:
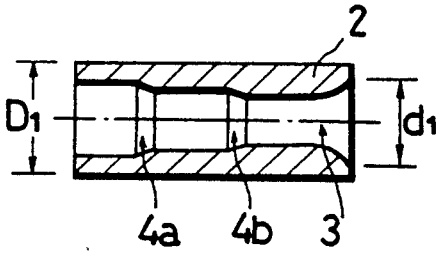
Figure 5A:
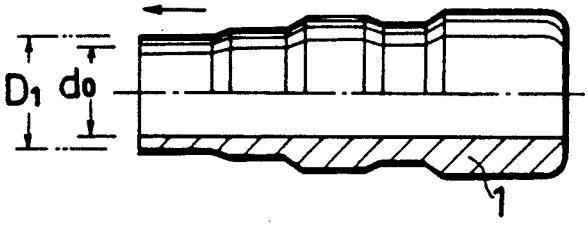
Figure 5B:
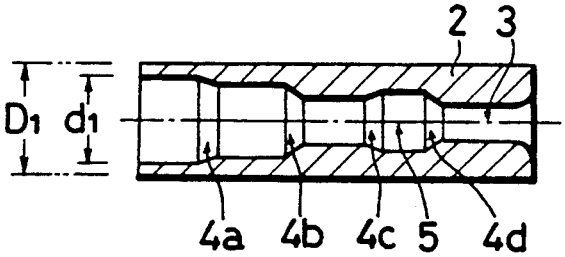

In addition to such a nozzle member as in the embodiment described above, nozzle members of various inside profiles can be produced according to the present invention. For example, also a nozzle member which has a throat portion 3 as shown in FIG. 3(B), another nozzle member which has a throat portion 3 and a plurality of stepped portions 4*a* and 4*b* as shown in FIG. 4(B) and a further nozzle member which has a plurality of stepped portions 4*a*, 4*b*, . . . and has an expanded portion 5 of a greater diameter at an intermediate portion thereof as shown in FIG. 5(B) can be produced in a similar manner to the embodiment described hereinabove with reference to FIGS. 1(A) to 1(E). FIGS. 3(A), 4(A) and 5(A) show configurations of the pipe stocks 1 before drawing from which the nozzle members 2 shown in FIGS. 3(B), 4(B) and 5(B) are to be produced, respectively. In each of FIGS. 3(A), 4(A) and 5(A), an arrow mark indicates the drawing direction of a pipe stock 1 and the dimension $D_1$ indicated by two-dot chain lines denotes a bore size of a die 20 to be used while the dimension $d_1$ denotes a maximum inner diameter of a nozzle member 2.

The inner diameter $d_0$ of a pipe stock 1 after working for an outside profile must necessarily be equal to or greater than the maximum inner diameter $d_1$ of a nozzle member 2 to be produced, and the pipe stock 1 from which such a nozzle member 2 is to be produced must necessarily have an outer diameter equal to the inner diameter $d_0$ to which twice the maximum thickness of material of the nozzle member 2 is added. Meanwhile, the bore size of the die 20 should be equal to an outer diameter of a nozzle member 2 to be produced where further finishing of an outside peripheral face of the nozzle member 2 is not taken into consideration, but where there is the necessity of such further finishing, an amount of finish should be added to set the bore size of the die 20 a little greater than an outer diameter of a nozzle member 2.

It is to be noted that since in the present embodiment a pipe stock is shaped by drawing such that an outside profile of the pipe stock is swollen in an axial symmetrical relationship into an inside profile of a nozzle member to be produced, the working accuracy of the inside profile almost depends upon the working accuracy of the outside profile. Accordingly, if the outside profile is worked with a high degree of accuracy and the inside profile is subjected, if necessary, to abrasive grain fluid polishing after drawing of the pipe stock, a nozzle member with a very high degree of accuracy can be obtained.

As described so far, according to the present invention, since a pipe stock is shaped such that an outside profile thereof may appear in an axial symmetrical relationship on an inside profile thereof, a nozzle member which is too complicated in inside profile to work the same by wire cutting electric discharge machining or by mechanical machining can be produced readily as a single part with a high degree of accuracy.

Further, where the length of a stock is set so as to be smaller by an amount corresponding to an elongation percentage upon drawing, there is an effect that the accuracy of the inside profile of a nozzle member to be produced can be further improved.

In the following, discussion actual examples of production experimental of nozzle members will be described, but the present invention is not limited to the experimental examples.

EXPERIMENTAL EXAMPLE 1

A pipe stock 1 made of SUS304L (JIS, Japanese Industrial Standards) and having such a configuration as shown in FIG. 1(A) was used wherein $D_0=6.5$ mm and $d_0=3.5$ mm, and a nozzle member 2 was produced wherein $D_1=6.0$ mm, $d_1=3.5$ mm, $d_2=3.0$ mm and $L_1=104$ mm. The elongation percentage $\alpha$ then was $\alpha=1.07$, and the drawing speed was 3 to 4 m/minute under a drawing force of about 10 tons. The roughness of inner and outer surfaces of the pipe stock after working for the outside profile was about 8 S (JIS B0601), but the roughness of the inner surface after drawing was about 10 S. Thus, the inner surface was subjected to abrasive grain fluid polishing. As a result, about a 3 S value of the roughness of the inner surface was obtained.

EXPERIMENTAL EXAMPLE 2

The parameters in Experimental Example 1 above was modified in that $D_0$ and $d_0$ was changed to $D_0=7.5$ mm and $d_0=4.5$ mm, respectively, and a nozzle member was obtained wherein $D_1=6.0$ mm, $d_1=4.5$ mm, $d_2=3.0$ mm and $L_1=184$ mm. The elongation percentage $\alpha$ then was $\alpha=1.18$.

Obviously, numerous modifications and variations of the present invention are possible in light of the above teachings. It is therefore to be understood that within the scope of the appended claims, the invention may be practiced otherwise than as specifically described herein.

What is claimed is:

1. A process for producing a nozzle member for sucking or transporting a string of yarn from a hollow pipe stock, said process comprising the steps of:

machining an outer surface of a hollow pipe stock having a substantially uniform inner diameter, thereby forming a variation in thickness along an axial direction of said hollow pipe stock;

drawing said machined hollow pipe stock without a mandrel through a bore of a die, thereby deforming said outer surface of said machined hollow pipe stock and thereby varying said inner diameter of said machined hollow pipe stock along said axial direction to correspond to said variation in thickness of said machined pipe stock thereby producing a drawn hollow pipe stock having a minimum inner diameter and a maximum inner diameter; and dividing said drawn hollow pipe stock at said minimum inner diameter, thereby forming said nozzle members having varying inner diameters adapted for sucking or transporting said string of yarn.

2. A process for producing a nozzle member according to claim 1, wherein the bore of the die is substantially equal to the outer diameter of the nozzle member.

3. A process for producing a nozzle member according to claim 1, which comprises setting the axial length of the pipe stock so as to be smaller by an amount corresponding to an elongation percentage of the pipe stock upon drawing.

4. A process for producing a nozzle member according to claim 1, wherein the outer diameter of the material for the pipe stock is greater than the inner diameter of a pipe stock to which twice a maximum thickness of material of the nozzle member is added.

5. A process for producing a nozzle member according to claim 1, which comprises polishing an inner peripheral face of the nozzle member with hard grain.

6. A process for producing a nozzle member according to claim 1, wherein during drawing, an area decreasing rate of said pipe stock is:

$$R=(D_0^2-D_1^2)/D_0^2$$

where $D_0$ is an outer diameter of said pipe stock before drawing and $D_1$ is an outer diameter of said pipe stock after drawing.

7. A process for producing a nozzle member as claimed in claim 1, wherein said dividing step comprising cutting said drawn hollow pipe stock thereby forming a pair of said nozzle members.

* * * * *